US006531658B2

(12) United States Patent
Tanaka et al.

(10) Patent No.: US 6,531,658 B2
(45) Date of Patent: Mar. 11, 2003

(54) SHIELDED CABLE

(75) Inventors: Atsuo Tanaka, Nagoya (JP); Shizuya Kawabe, Nagoya (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/022,236

(22) Filed: Dec. 20, 2001

(65) Prior Publication Data

US 2002/0084088 A1 Jul. 4, 2002

(30) Foreign Application Priority Data

Dec. 21, 2000 (JP) ..... 2000-389352

(51) Int. Cl.[7] ..... H01B 7/08
(52) U.S. Cl. ..... 174/117 F
(58) Field of Search ..... 174/117 F, 117 FF, 174/36, 110 PM, 110 F

(56) References Cited

U.S. PATENT DOCUMENTS 5,008,489 A * 4/1991 Weeks et al. ..... 156/291
6,261,683 B1 * 7/2001 Tanaka ..... 174/107

FOREIGN PATENT DOCUMENTS

| | | |
|---|---|---|
| JP | 63-19711 | * 1/1988 |
| JP | 1-298605 | * 12/1989 |
| JP | 6-84411 | * 3/1994 |

* cited by examiner

*Primary Examiner*—Chau N. Nguyen
(74) *Attorney, Agent, or Firm*—Oliff & Berridge, PLC

(57) ABSTRACT

A flat-type shielded cable includes a plurality of signal wires 21, each having an insulating covering member, and a drain wire 22, which are juxtaposed to one another in closely-contacted relation to one another, a shielding layer 23, and an insulating sheath 24, the shielding layer and the insulating sheath sequentially covering an outer periphery of the juxtaposed wires. This cable is characterized in that an outer diameter of the signal wire 21 is in a range of 1.25 mm to 1.4 mm, and an cross-sectional area of a conductor 21*a* of the signal wire 21 is 0.03 to 0.09 $mm^2$, and the insulating covering member 21*b* of the signal wire 21 is made of an insulative material having a dielectric contact of 1.7 to 2.8, and a characteristic impedance of the signal wire 21 is 75Ω (±10%).

5 Claims, 2 Drawing Sheets

SHIELDED CABLE

BACKGROUND OF THE INVENTION

1. Field of the Invention

This invention relates to a shielded cable used for electrically connecting an electrical equipment in a vehicle such as an automobile.

2. Description of the Related Art

In a vehicle such as an automobile, shielded cables have been used for electrical connection to various electrical equipments. FIG. 1 is a cross-sectional view showing a construction of a shielded cable according to a related art.

In FIG. 1, reference numeral 10 denotes the shielded cable comprising a plurality of signal wires 11 and a drain wire 12, which are twisted together, a shielding layer 13 covering an outer periphery of these wires 11, 12, and an insulating sheath 14 covering an outer periphery of this shielding layer 13. The signal wire 11 comprises a conductor 11*a* and an insulating covering member 11*b* covering an outer periphery of this conductor 11*a*.

In this construction, external noises are intercepted by the shielding layer 13 and the intercepted noises are fed to an earth through the drain wire 12. Good signals are supplied to various electrical equipments through the signal wires 11.

With respect to the commonly-used specification of the shielded cable 10 of this kind according to the related art, the cross-sectional area of the signal wire 11 is 0.3 $mm^2$, the outer diameter of the conductor 11*a* of the signal wire 11 is 1.4 mmϕ, the material of the insulating covering member 11*b* is polyvinyl chloride (PVC), the material of the shielding layer 13 is copper or aluminum, and the material of the insulating sheath 14 is polyvinyl chloride, polyethylene or the like.

On the other hand, recently, with the rapid development of a car navigation system and a DVD equipment, a monitor, a DVD unit and so on have now been mounted on automobiles. However, since an image, a voice and so on of these electrical/electronic equipments have become finer and higher in quality, for example, with respect to the monitor of the car navigation system, there has occurred a phenomenon in which blurring develops in an enlarged image of a road map or the like, and it has been desired to take any countermeasure.

And besides, in the shielded cable according to the related art, the signal wires 11 and the drain wire 12 are formed into the twisted-wire combination structure, and therefore it is not easy to process an end portion of the wires 11, 12 (for connection to connector terminals), and much time is required for the processing of the end portion thereof. In addition, since the insulating sheath 14 and the shielding layer 13 need to be removed over a length of about 80 mm to provide a length of processed end portion, there is encountered a problem that the shielding performance is degraded.

Furthermore, in connection with the standards of connectors of electrical/electronic equipments to be newly mounted on automobiles, the outer diameter of the signal wire 11 is required to be 1.3 mmϕ, and with respect to the standards of the conventional connectors, the outer diameter of the signal wires of 1.4 to 1.6 mmϕ prevails. Therefore, the outer diameter of the signal wires must be narrowed; otherwise such outer diameter would not be suited for the connectors of the equipments to be newly mounted.

SUMMARY OF THE INVENTION

This invention seeks to solve these problems of the related art, and an object of the invention is to provide a shielded cable which maintains a shielding performance, can be easily subjected to an end processing, and can be sufficiently adapted for the latest electronic/electrical equipments to be newly mounted on a vehicle such as an automobile.

The inventor of the present invention has dedicated to a study to solve the above problems, has obtained the following findings, and has completed the present invention.

Troubles encountered with the electronic/electric equipments newly mounted on an automobile are much concerned with the characteristic impedance of the signal wires and its value of the signal wires according to the related art is about 50Ω. It is thought that when the shielded cable according to the related art is used and connected to an equipment, such as a DVD unit, a monitor, and the like, reflection occurs between the signal-supplying side and the equipment because of unmatching of the impedance, so that the above troubles occur. Therefore, it has been confirmed that by increasing the characteristic impedance of the signal wire to about 75Ω (±10%), the matching can be obtained so that the above troubles can be overcome. On the other hand, in connection with the standards of the connectors of the electronic/electrical equipments to be newly mounted, the outer diameter of the signal wire need to be 1.3 mmϕ. It has been confirmed that in view of these, by adjusting the size of a cross-sectional area of the conductor of the signal wire and the dielectric constant of the insulating covering member of the signal wire, the required characteristic impedance can be obtained. Incidentally, the dielectric constant of polyvinyl chloride used to form the insulating covering member of the signal wire according to the related art is about 5.0.

In order to solve the above problems, according to a first aspect of the invention, there is provided a flat-type shielded cable comprising: a plurality of signal wires having insulating covering members and conductors, respectively; and a drain wire, wherein the plurality of signal wires ad the drain wire are juxtaposed to one another in closely-contacted relation to one another; a shielding layer and an insulating sheath cover an outer periphery of the juxtaposed wires sequentially; an outer diameter of the signal wire is in a range of 1.25 to 1.40 mm; a cross-sectional area of the conductor of the signal wire is in a range of 0.03 to 0.09 $mm^2$; the insulating covering member of the signal wire is made of an insulative material having a dielectric constant of 1.7 to 2.8; and a characteristic impedance of the signal wire is 75Ω (±10%)

According to a second aspect of the invention, there is provided the shielded cable according to the first aspect of the invention, wherein the insulating covering member of the signal wire is foamed polyethylene.

According to a third aspect of the invention, there is provided the shielded cable according to any one of the first and second aspects of the invention, wherein a cross-sectional area of the drain wire is in a range of 0.20 to 0.57 $mm^2$.

According to a fourth aspect of the invention, there is provided the shielded cable according to any one of the first to third aspect of the invention, wherein the drain wire is provided at one of ends of the plurality of juxtaposed signal wires having the insulating cover member, respectively.

According to a fifth aspect of the invention, there is provided the shielded cable according to any one of the first to third aspect of the invention, wherein the drain wire is provided among the plurality of juxtaposed signal wires having the insulating covering members, respectively.

DETAILED DESCRIPTION OF THE PREFERRED EMBODIMENTS

A preferred embodiment of the present invention will now be described.

Figure 1:
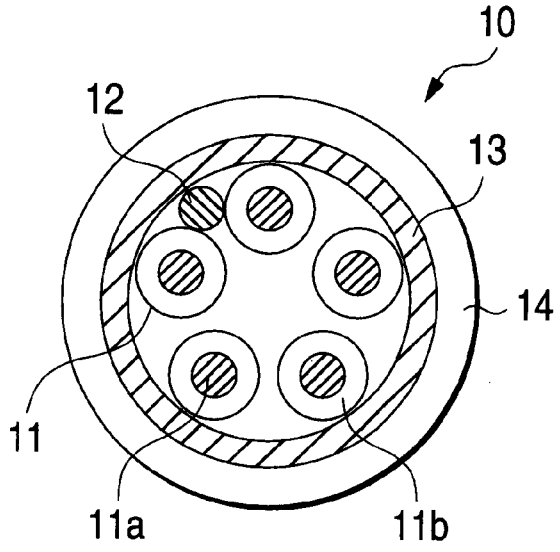
FIG. 1 is a cross-sectional view showing a structure of a shielded cable according to the related art.
Figure 2:
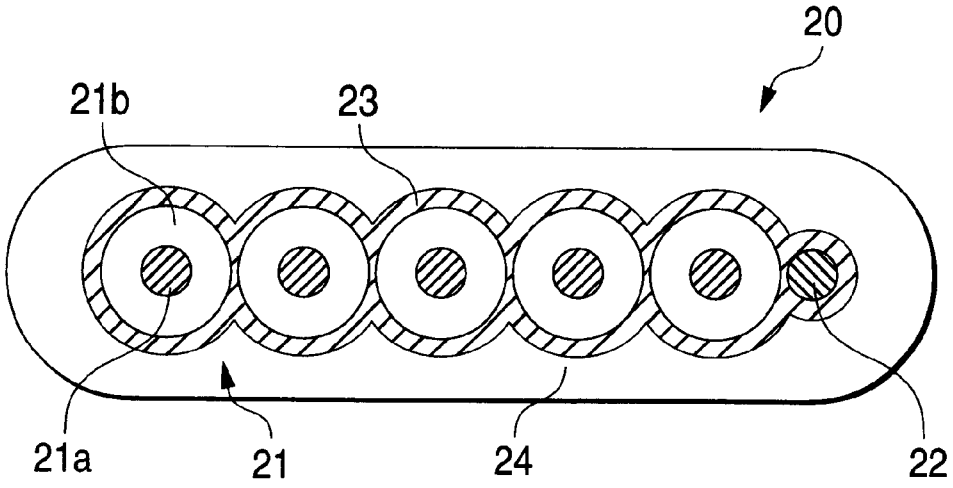
FIG. 2 is a cross-sectional view showing a structure of a shielded cable according to one preferred embodiment of the present invention.

In FIG. 2, reference numeral 20 denotes a flat-type shielded cable according to the present invention. This shielded cable 20 comprises a plurality of signal wires 21 and a drain wire 22, which are juxtaposed to one another in closely-contacted relation to one another, a shielding layer 23 covering an outer periphery of these wires 21, 22, and an insulating sheath 24 covering an outer periphery of this shielding layer 23. The signal wire 21 comprises a conductor 21*a*, and an insulating covering member 21*b* covering an outer periphery of this conductor 21*a*.

The outer diameter of each of the signal wires 21 is set to 1.3 mmϕ and this value may include a nominal error. That is, the outer diameter of each of signal wires 21 may be in a range of 1.25 mmϕ to 1.4 mmϕ.

In the present invention, the characteristic impedance of the signal wire 21 is set to about 75Ω (±10%), that is, 67.5 to 82.5Ω. If this characteristic impedance is outside this range, unmatching, in some cases, occurs.

The cross-sectional area (hereinafter referred to as "conductor size") of the conductor 21*a* of the signal wire 21 is 0.03 to 0.09 $mm^2$. If the conductor size is smaller than this range, a good signal transmission can not be effected and besides the strength of the signal wire 21 is insufficient. If the conductor size is larger than this range, it is difficult to obtained required characteristic impedance. Preferably, the conductor size of the conductor 21*a* is in a range of 0.07 to 0.09 $mm^2$. A twisted soft copper wire (including a compressed twisted wire), a soft copper single-conductor wire, a twisted, tin-plated soft copper wire, or the like can be used as the conductor 21*a*.

The insulating covering member 21*b* of the signal wire 21 is made of an insulative material having a dielectric constant of 1.7 to 2.8. Although examples of such a material include foamed polyethylene and tetrafluoroethylene, particularly foamed polyethylene is preferred in view of the cost, durability and so on. By adjusting the expansion ratio of foamed polyethylene, it can have the dielectric constant falling within the above range. If the dielectric constant of the insulating covering member 21*b* is smaller than 1.7, the production of the wire is extremely difficult, and if the dielectric constant is too large, it is difficult to obtain the required characteristic impedance. Preferably, the dielectric constant of the insulating covering member 21*b* of the signal wire 21 is in a range of 1.7 to 2.0. The thickness of the insulating covering member 21*b* is determined in accordance with the conductor size of the conductor 21*a* (since the outer diameter of the signal wire 21 is determined).

The number of the juxtaposed signal wires 21 can be arbitrarily determined according to a use.

Figure 3:
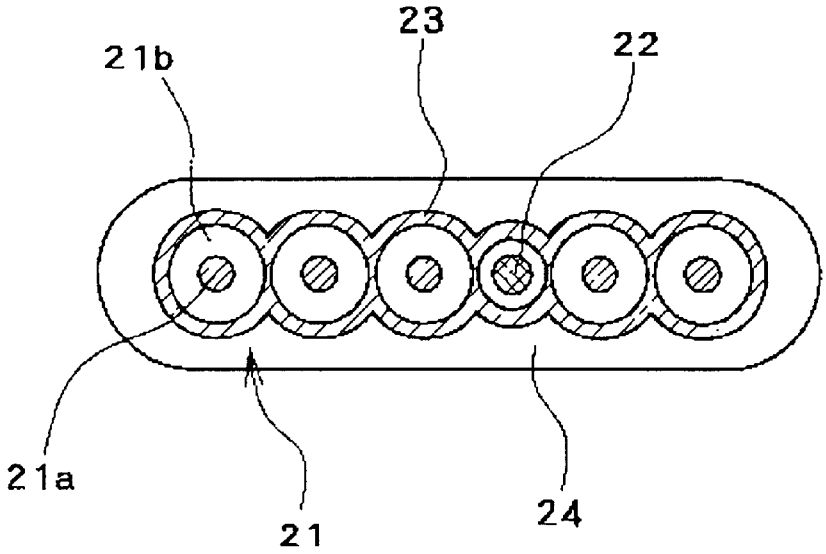
FIG. 3 is a cross-sectional view showing the structure of a shielded cable according to another embodiment.

The drain wire 22 is formed by a material such as a soft copper wire or a Sn-plated soft copper wire. Preferably, the conductor size of the drain wire is 0.20 to 0.57 $mm^2$. If the conductor size is smaller than this range, the conductor size can not makeup for the insufficient strength of the drain wires 21. If the conductor size is larger than this range, the conductor size is not suited for the dimensions of a connector. Preferably, the conductor size of the drain wire 22 is in a range of 0.20 to 0.25 $mm^2$ or 0.27 to 0.37 $mm^2$ or 0.47 to 0.57 $mm^2$. With respect to an arrangement of the drain wire 22, the drain wire 22 is provided at one end of the group of juxtaposed signal wires 21 as shown in FIG. 2, but the drain wire 22 may provided between the signal wires 21 as shown in FIG. 3.

A material having a shielding effect is used to form the shielding layer 23. More specifically a Sn-plated copper foil PET tape, a Sn-plated copper foil/PET tape, an aluminum PET tape or the like can be used and the thickness thereof is about 10 to about 30 μm.

A material having insulating properties, oil resistance and chemical resistance, is used to form the insulating sheath 24. More specifically, an insulative material such as polyvinyl chloride and a polyolefin resin such as polyethylene can be used and the thickness thereof is about 0.3 mm.

Here, one example of shielded cable 20 of the present invention will be described.

When the shielded cable 20 having the structure of FIG. 2 and including five signal wires is prepared by using a twisted, Sn-plated soft copper wire (conductor size: 0.08 $mm^2$) as the conductor 21*a*, foamed polyethylene (dielectric constant: 1.7; thickness: 0.46 mm) as the insulating cover member 21*b*, a stranded, Sn-plated soft copper wire (conductor size: 0.22 $mm^2$) as the drain wire 22, a Cu-PET tape (thickness: 16 μm) as the shielding layer 23, and a halogen-free material (thickness: 0.3 mm) as the insulating sheath 24, the characteristic impedance thereof is 71Ω.

Figure 4:
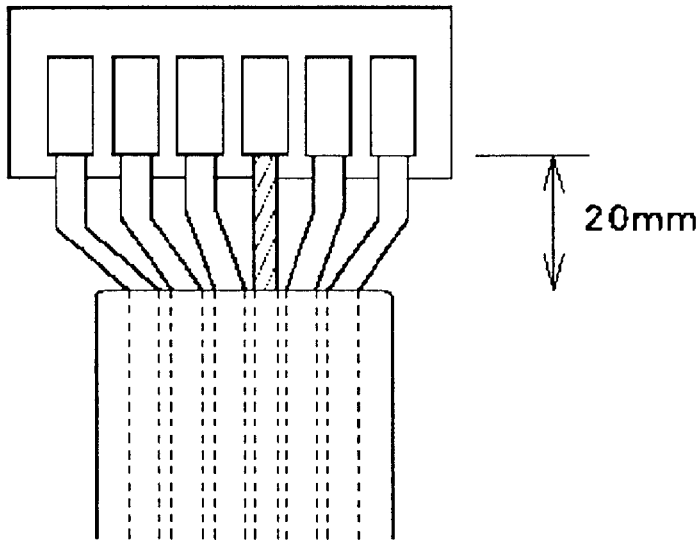
FIG. 4 is a view explanatory of processing of an end portion of the shielded cable according to the invention.

The end portion of the shielded cable 20 of the present invention can be processed as shown in FIG. 4. More specifically, the shielding layer 23 and the insulating sheath 24 are removed over a length of about 20 mm from the end portion and the distal end thereof is arranged in accordance with a connector pitch of an equipment and is connected thereto in a lump. As a result, the degradation of the shielding performance at the end portion is prevented and besides the processing of the end portion is easy.

In the present invention, the above construction is adopted and therefore the cable can applied to an equipment such as a DVD unit and a monitor to be mounted on an automobile. Further more, since the matching of the impedance can be obtained relative to such an equipment, troubles such as the blurring of an image in the monitor are eliminated.

In addition, since the flat cable according to the present invention has a flat design, the flat cable can be connected to the connector in a lump and the time required for processing the end portion can be reduced.

Furthermore, the length of removal of the insulating sheath and shielding layer, which corresponds to the length of the processed end portion, is kept merely to about 20 mm, and therefore the shielding performance can be secured.

Furthermore, the flat cable according to the invention is more lightweight than the cable according to the related art and besides requires a smaller installation space.

What is claimed is:

1. A flat-type shielded cable comprising:

a plurality of signal wires having insulating covering members and conductors, respectively; and a drain wire, wherein the plurality of signal wires and the drain wire are juxtaposed to one another in closely-contacted relation to one another;

a shielding layer and an insulating sheath sequentially cover an outer periphery of the juxtaposed wires, the shielding layer interposed between signal wires, separating the signal wires from each other;

an outer diameter of each signal wire is in a range of 1.25 mm to 1.4 mm;

a cross-sectional area of the conductor of each signal wire is in a range of 0.03 to 0.09 $mm^2$;

the insulating covering member of each signal wire is made of an insulative material having a dielectric constant of 1.7 to 2.8; and a characteristic impedance of each signal wire is 75Ω (±10%).

2. The shielded cable according to claim 1, wherein the insulating covering member of each signal wire is foamed polyethylene.

3. The shielded cable according to claim 1, wherein a cross-sectional area of the drain wire is in a range of 0.20 to 0.57 $mm^2$.

4. The shielded cable according to claim 1, wherein the drain wire is provided at one of ends of the plurality of juxtaposed signal wires having the insulating cover member, respectively.

5. The shielded cable according to claim 1, wherein the drain wire is provided among the plurality of juxtaposed signal wires having the insulating covering members, respectively.

* * * * *